US009708820B2

(12) United States Patent
Berger

(10) Patent No.: US 9,708,820 B2
(45) Date of Patent: Jul. 18, 2017

(54) LOCKING DEVICE HAVING STOP FOR ANCHOR ROD AND PROCESS

(71) Applicant: Hünnebeck GmbH, Ratingen (DE)

(72) Inventor: Martin Berger, Kinnelon, NJ (US)

(73) Assignee: Hünnebeck GmbH, Ratingen (DE)

( * ) Notice: Subject to any disclaimer, the term of this patent is extended or adjusted under 35 U.S.C. 154(b) by 0 days.

(21) Appl. No.: 14/415,594

(22) PCT Filed: Jul. 12, 2013

(86) PCT No.: PCT/EP2013/064762

§ 371 (c)(1),
(2) Date: Jan. 18, 2015

(87) PCT Pub. No.: WO2014/012854

PCT Pub. Date: Jan. 23, 2014

(65) Prior Publication Data

US 2015/0152909 A1 Jun. 4, 2015

(30) Foreign Application Priority Data

Jul. 18, 2012 (DE) ..... 10 2012 212 600

(51) Int. Cl.
*E04G 17/065* (2006.01)

(52) U.S. Cl.
CPC ..... *E04G 17/0652* (2013.01); *Y10T 29/49948* (2015.01)

(58) Field of Classification Search
CPC ..... E04G 17/0601; E04G 17/0605; E04G 17/065; E04G 17/0652; Y10T 29/49948
USPC ..... 249/40, 41, 46, 190, 191, 213, 216
See application file for complete search history.

(56) References Cited

U.S. PATENT DOCUMENTS 1,137,998 A * 5/1915 Merriett ..... E04G 11/10 249/191
1,387,766 A * 8/1921 Colt ..... E04G 17/0707 24/19
1,424,880 A * 8/1922 Colt ..... E04G 17/07 24/19
2,084,384 A * 6/1937 Colt ..... E04G 17/07 249/219.2
2,395,204 A * 2/1946 Symons ..... E04G 17/0754 24/135 N
5,762,815 A * 6/1998 Lee ..... E04G 17/065 249/155

(Continued)

FOREIGN PATENT DOCUMENTS

DE 20 2012 003778 U1 5/2012
WO WO-2008/089737 A1 7/2008

OTHER PUBLICATIONS

International Search Report mailed Oct. 11, 2013; Authorized Officer: Tryfonas, N.

*Primary Examiner* — Michael Safavi
(74) *Attorney, Agent, or Firm* — Winstead PC

(57) ABSTRACT

The Invention relates to a locking device for an anchor rod of a wall formwork. Moreover the invention relates to an anchoring system having an anchor rod and a locking device; as well a process for mounting a wall formwork. The locking device for an anchor rod of a wall formwork comprises a thread for the insertion of one end of the anchor rod and a stop which is removable from its stop position for an anchor rod end which is screwed into the thread.

14 Claims, 1 Drawing Sheet

(56) References Cited

Figures 1, 2, 3:
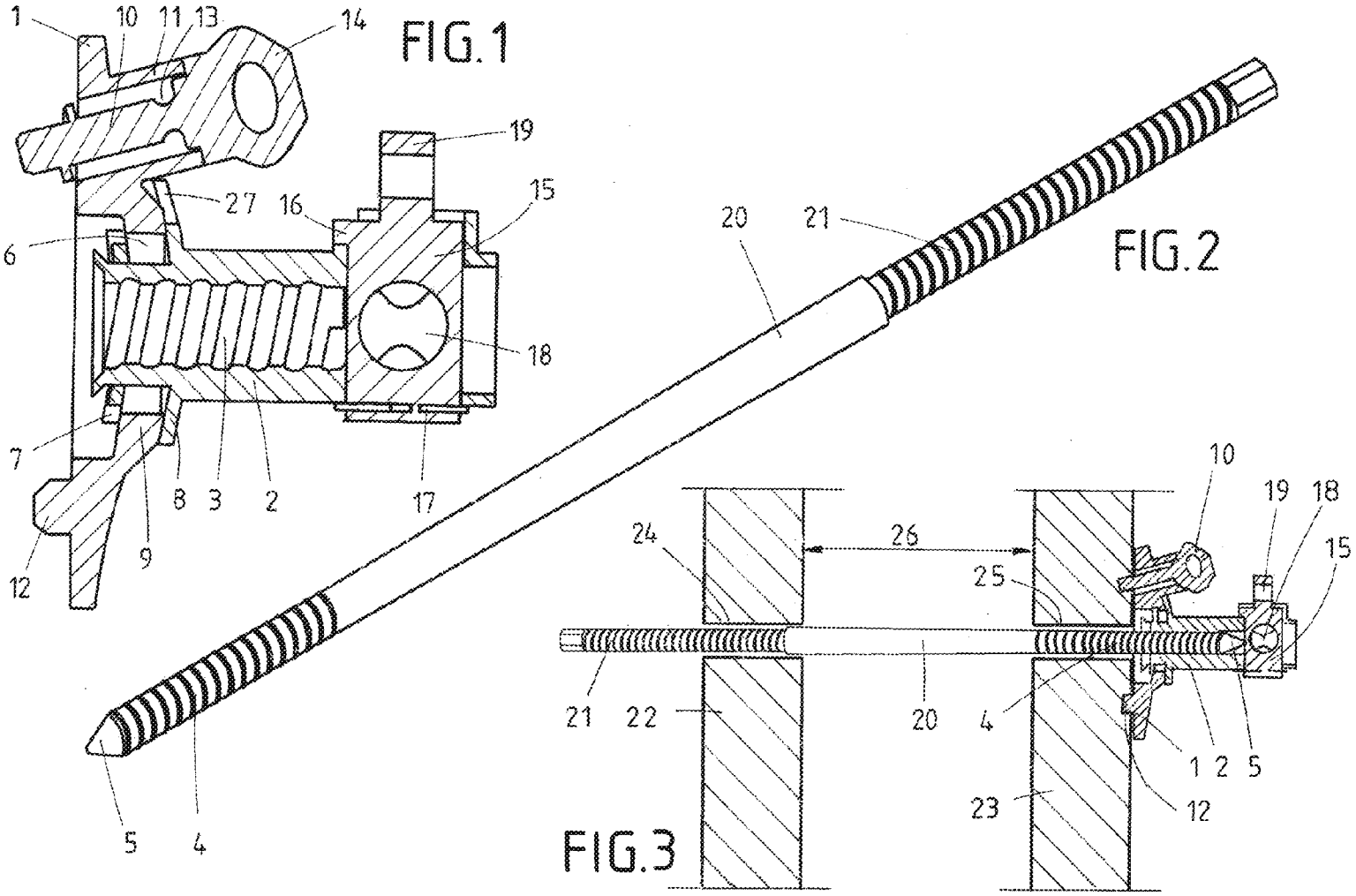

U.S. PATENT DOCUMENTS 7,152,843 B2 * 12/2006 Ward ..... E04G 17/0651
249/216

* cited by examiner 1
2
3
4
5
6
7
8
9
10
11
12
13
14
15
16
17
18
19
20
21
22
23
24
25
26
27

LOCKING DEVICE HAVING STOP FOR ANCHOR ROD AND PROCESS

The invention relates to a locking device for an anchor rod of a wall formwork. Moreover the invention relates to an anchoring system having an anchor rod and a locking device as well as a process for mounting a wall formwork.

An anchoring system according to the present invention is used in formwork technology in the context of mounting wall formworks for a concrete casting process of reinforced concrete constructions. On the front side a wall formwork comprises a formwork facing and on the back side the formwork facing comprises supporting elements such as longitudinal beams, crossbars and frames. Both sides of a wall to be cast in concrete are encased by wall formworks. In this way the front side of each wall formwork is adjacent to the concrete. Generally opposite wall formworks are held by a multitude of anchoring systems. The anchor rods are passed through openings in the wall formworks and will be mounted at their ends to elements supporting the respective formwork facing such that at least the tensile force acting onto the anchor rods during concrete casting will be absorbed.

Generally both ends of the anchor rods have threads into which screw nuts are inserted as an anchor fixation. Basically the central area of an anchor rod to which, during concrete casting, concrete may be adjacent either has a smooth surface or at least will be encased by a bushing having a smooth surface. In this way the effective length of the anchor rod and thus the strength (thickness) of the wall to be concrete cast will be defined. At the same time pressure exerted onto the formwork facing by liquid concrete during casting will be dissipated via the screw nuts to the anchor rods. The anchor rods thereby will be tensile-strained.

Between the formwork facings spacers may be inserted into the volume of the wall to be cast which may absorb the compression forces emerging during casting, thereby assuring these compression forces not to affect the wall strength in an undesirable manner, i.e. reducing the wall strength. Alternatively or additionally the locking devices may also be mounted onto the wall formworks so that the latter may also be able to absorb compression forces.

From the document WO 08089737 A1 an anchoring system having two locking devices and one anchor rod for a wall formwork having a first and a second formwork element is known. The anchor rod on each of its both ends has a thread which is inserted into the screw nut elements of the locking devices. Each locking device comprises a cap plate which is mounted to a back side of a wall formwork by way of mounting means. The screw nut element may movably be mounted to the cap plate and, similarly to a joy stick, may be deflected on the cap plate. The anchoring system may therefore absorb both tensile and compression forces of a wall formwork.

The features mentioned above which are known from prior art may individually be combined or may be combined in any combination with the article according to the invention.

It is an object of the present invention to refine a locking device for an anchoring system along with a process for erecting a wall formwork.

The object of the invention will be solved by way of a locking device having the features of claim 1 as well as a process having the features of the further independent claim. Advantageous embodiments will arise from the subclaims.

The locking device according to the claims is characterized in that a user may fixedly connect the end of an anchor rod to a locking device at two specified positions without the need of looking at the locking device at the time while connecting. An anchor rod may therefore be passed to different extends through two wall formworks which are opposite to each other for concrete casting in order to finally connect the end of the anchor rod which was passed through or pushed through, respectively, to the locking device at a predetermined position. As a result of this it will be enabled to increase the effective length of an anchor rod in comparison to prior art which was mentioned before without the need of compromising handling thereof. Especially it is possible to produce wall thicknesses varying up to 25 cm with the use of solely one type of anchor rod. Specifically it therefore is possible to produce concrete walls which are 15 cm to 40 cm in thickness with the use of solely one type of anchor rod. Provision of anchor rods of different lengths is not required nor is the provision of a second person in order to be able to connect the end of an anchor rod which was passed through the wall formworks at a desired position without compromising handling.

The invention enables utilization, as an adjustment range, of the thickness of both of the opposite formworks especially for a bushing-and-jacketless anchor which is connected to the formwork having tensile and compression resistance, i.e. utilization not only of the thickness of one of the frameworks which are opposite to each other, such as in prior art.

The anchor rod is to be inserted at least into the locking device to the first position in order to enable concrete casting without serious drawbacks. The anchor rod is maximally to be inserted into the locking device to the second position in order to enable concrete casting without serious drawbacks.

In one embodiment the invention relates to a locking device for an anchor rod of a wall formwork preferably having a thread for screw mounting of one end of the anchor rod. The locking device furthermore comprises a stop which is removable from its stop position for an end of an anchor rod which is screwed to the thread.

Removable from a stop position means that the stop may be moved or altered without the use of tools, so that functioning as a stop for an anchoring end which is screwed into the locking device will no longer will be possible. The stop is for sensing the first mounting position without the need of having to look at the locking device. Basically there is a second stop which enables sensing the reach of the second position without the need of having to look at the locking device. In a simple embodiment this second stop is not removable.

In case that the stop has not been removed, i.e. has not been displaced from its stop position, the end of the anchor rod may not be inserted into the locking device beyond the stop, i.e. for example it may be inserted into the thread which preferably is provided. In case that the stop will be removed, the end of the anchor rod may further be advanced beyond the stop position into the locking device, especially may be screw mounted to the thread.

By the provision of a thread the end of an anchor rod may be connected to the locking device in a simple and conventional manner. However, the invention does not necessarily require a thread, especially since it is not essential to be able to smoothly connect the end of the anchor rod which has been passed through to the locking device. The end of the anchor rod could for example be provided with a projection which may be displaced by turning the anchor rod into a position maintained by the locking device, thereby connecting the locking device to the end of the anchor rod which has been passed through.

If the locking device is provided with a thread, this end of the anchor rod has an appropriate counter thread, and at most an external thread in general. In this case the locking device has an internal thread. It is also possible that the end of the anchor rod is provided with an internal thread and the locking device comprises an external thread corresponding thereto.

For installation the anchor rod of an anchoring system will be inserted from one side through designated openings of two wall formworks which are erected opposite to each other in order to subsequently insert the end of the anchor rod which finally has been passed through both openings into a thread according to the claims, especially by screwing it in. Basically the anchor rod is first passed through a back side of a wall formwork. After passing a distance between this first wall formwork and a second wall formwork which is opposite to it the end of the anchor rod which has been passed through reaches an opposite opening of the second wall formwork. The end of the anchor rod which has been passed through subsequently will first be passed from the front side of the second wall formwork towards the back side through the second wall formwork and then reaches the locking device located in this place. If the stop of this locking device has not been removed the anchor rod will be inserted up to the stop, especially will be screwed in. The stop then avoids further inserting or screwing the anchor rod into the locking device or the thread of the locking device, respectively.

The thickness of the wall formwork adjacent to the end of the anchor rod which has been passed through is dimensioned such that mounting means, i.e. especially the thread of the end of the anchor rod which has been passed through will be located outside the range between the two wall formworks which, for producing a concrete wall, will be filled with concrete. The distance between the two front sides of the adjacent wall formworks defines the thickness of a concrete wall to be produced.

If the stop has been removed, the end of the anchor rod which has been passed through basically will be inserted or screwed into the locking device or the thread of the locking device, respectively, in a maximally possible manner. In an especially simple embodiment insertion will then be limited by the length of the thread of the anchor rod end which has been passed through. In this way a second stop is provided in a simple embodiment.

Subsequently another locking device will be mounted to the other end of the anchor rod corresponding to the designated thickness of the wall to be produced. The locking device may be a common locking device which is known from state of the art. Basically, this other locking device comprises a thread which may be applied to the end of the anchor rod which has not been passed through by screwing it into the desired position corresponding to the thickness of the wall to be produced.

However, locking devices may basically also be mounted in a different order.

After applying the anchoring systems required for maintaining the wall formworks concrete will be cast between the formwork facings. If the concrete is cured the ends of the anchor rods which have been passed through will be screwed out and the anchor rods will subsequently be pulled out of the wall as well as of the wall formworks. The wall formworks will subsequently be removed.

The stop prevents a locking means, especially a thread of the anchor rod, from being located in the concrete wall. Otherwise an anchor rod could not be pulled out of the cured concrete wall in a non-destructive manner. Since the end which has been passed through may be inserted or screwed, respectively, into the locking device or the thread of the locking device to a different extend without having to consider the risk that the mounting means or the thread will protrude into the concrete wall, concrete walls of different thicknesses may be produced without the need of providing anchor rods of different lengths or high personnel expenses. Compared to prior art the effective length of an anchor rod may be increased in this way. Therefore, compared to prior art mentioned above especially the number of anchor rods required to produce walls of different thicknesses, and at most walls of 15 cm to 40 cm in thickness, may be reduced. The locking device having different stops allows utilization of the thicknesses of both of the adjacent formworks as an adjustment range, i.e. in this example ca. 25 cm. Walls having thicknesses of 15-40 cm represent a typical executive example. Other ranges of wall thicknesses which have practically been realized are between 35-60 cm.

In an embodiment of the invention the removable stop is movably, i.e. especially rotatably, mounted. By moving the stop it may be removed from its stop position or may be brought into its stop position. Losing the stop will advantageously be avoided due to its mounting.

In an embodiment of the invention the removable stop comprises a rotatable cylinder or a rod having a bore hole or an opening passing through the cylinder or rod. If the through hole or the opening extends transversally to the anchor rod which is screwed in, the cylinder or the rod will also serve as a removable stop, respectively. The removable stop then is in a stop position. If the through hole or the opening respectively extends towards or is parallel to the anchor(s) which is (are) screwed in, the end of the anchor rod which is inserted or screwed in, respectively, may be inserted or passed through, respectively, by way of advancing it or passing it through the bore hole or opening, respectively, such that the rod or the cylinder, respectively, may then no longer serve as a stop. By rotating the rod or the cylinder, respectively, the latter may be brought into a stop position or may be removed therefrom. If the rod or the cylinder is not in a stop position its through hole or opening especially is aligned with said thread of the locking device.

For securely mounting the rod or cylinder pass through a duct and in one embodiment have a bolt which radially protrudes to the exterior at one end which protrudes from its duct, a flange which radially protrudes to the exterior or a spring which radially protrudes to the exterior, which at one side prevents the rod or cylinder from being able to be passed through their ducts. The other protruding end of the rod or bolt is for example secured by a pin or locking ring in order not to fall out of their ducts. A pin subsequently extends transversally to the longitudinal extension of the rod or cylinder, is progressively located within a transversal bore hole of the rod or cylinder, respectively, and laterally protrudes at least at one side from the rod or cylinder, respectively. A locking ring subsequently is located within a circumferential groove and laterally protrudes from this circumferential groove.

In one embodiment of the invention a rod or cylinder end of the removable stops is provided with a handle, i.e. preferably with an elongated handle which advantageously extends parallel to the hole or opening of the rod or cylinder, respectively. Rotation of the handle results in rotation of the cylinder or the rod, respectively. If the handle is elongately formed the handle indicates the location of the opening or hole, respectively, and thus indicates the position of the removable stop. Especially a longitudinal extension of the handle parallel to the opening—as it is known from a faucet cock—enables intuitively sensing the stop position.

In an especially simple embodiment the removable stop is formed by a rod or cylinder which may be inserted into a bore hole passing through the thread. If the rod or cylinder has been inserted into the bore hole or opening, respectively, the rod or cylinder functions as a stop. If the rod or cylinder will be removed from the bore hole the former no longer may function as a stop.

Advantageously the rod or cylinder previously mentioned is mounted by way of a rope or a chain to the locking device so that the rod or cylinder may not get lost.

In one embodiment of the invention there is one or more engaging and/or fixing means by means of which the removable stop may be engaged or fixed, respectively, in a desired position, i.e. in a stop position and/or may be engaged or fixed, respectively, in a position distant from the stop position. In this way a removable stop also will be prevented from leaving its designated positions in a non-scheduled manner, i.e. for example leaving its stop position in a non-scheduled manner.

In one embodiment of the invention the locking device comprises a mounting device for mounting the locking device to a wall formwork. One single person will then be sufficient to mount the anchoring systems of a wall formwork. Basically the locking device will be mounted to the back side of a wall formwork and subsequently, for the sake of stability, will advantageously be mounted to a supporting element of the wall formwork.

In an embodiment the locking device comprises a cap plate to which the thread is movably mounted, and at most similar to a joy stick. In this way it will be avoided that an anchor rod may no longer be properly connected to a thread of a locking device if two designated openings of two adjacent wall formworks are not aligned to each other. By using the locking device in a concrete wall formwork wherein the formwork elements, and consequently the anchor through hole bores in the formwork facings, are not directly aligned in a way facing each other, compression forces acting upon the screw nut elements will radially be transmitted completely circumferentially in an extensive way from the cap surface to the screw nut elements despite the anchor rods not being perpendicular to the formwork facing surfaces. In this way a stable design of the concrete wall formwork will be assured. Furthermore possible damages of an anchoring system by local overload will be avoided.

In one embodiment of the invention the thread is mounted to the cap plate in a torque-proof manner. By this embodiment it will be accomplished that an inserted end of an anchor rod may be turned into the thread without preventing the thread from undesirably being entrained.

In one embodiment of the invention the cap plate comprises the mounting device in order to be able to mount the cap plate and thereby also the locking device to a wall formwork. It thereby will be accomplished that the cap plate may be positioned at an appropriate position on the exterior of a wall formwork properly and sustainably in order allow screwing in the inserted end of an anchor rod into the thread of the locking device.

In one embodiment of the invention the mounting device simultaneously is part of a torsion protection in order to mount the thread on the cap plate in a torsion-proof manner. Hence the mounting device adopts another function, thus simplifying the design of the locking device.

In one embodiment of the invention the mounting device comprises a bushing for accommodating a screw. The screw passes through the bushing such that its thread may be screwed into a designated opening in a wall formwork thus mounting the locking device to a wall formwork.

In one advantageous embodiment of the invention the screw is accommodated by the bushing such that it may be twisted in relation to the bushing but may not be moved parallel to the bushing. The screw is thereby securely connected to the locking device in a suitable manner. Preferably the screw also is securely mounted and may not fall out of the bushing.

An anchoring system according to the invention of a concrete wall formwork comprises an anchor rod and a first and second locking device, wherein the anchor rod is screwed into the threads of the locking devices.

Preferably the anchor rod tapers towards an anchor rod end, at least progressively. The end having the smaller diameter is inserted into the openings of a wall formwork in order to finally screw it to the thread of the locking device. Preferably at least the section of the anchor rod which has a smooth surface and which is located between two ends of the anchor rod, which each are provided with a thread tapers. The smooth area tapers towards its end which is to be inserted into a wall formwork. Pulling out an anchor rod of a cured concrete wall is facilitated.

Preferably the end provided with an external thread of the anchor rod which is to be passed through wall formworks has a tapered end in order to allow threading this end into the designated internal thread of the locking device.

In one embodiment of the invention an anchoring system is designed such that in this way concrete walls up to 40 cm in thickness may be produced without the need of using anchor rods of different lengths. With such an anchoring system a central section of the anchor rod which does not comprise a thread is 40 cm in length or slightly longer, for example up to 45 cm in length. This section ha a smooth surface.

In one embodiment of the invention the associated wall formworks have thicknesses such that walls which are only 15 cm in thickness may be produced with the anchor rod which is dimensioned in the foregoing manner. Especially, in this case, the overall thickness of two adjacent wall formworks is 25 to 28 cm. Preferably both of the wall formworks are of equal thicknesses for versatile use. The thickness of each wall formwork then preferably is 12.5 cm to 14 cm. The overall thickness and thus the thickness of each wall formwork may also be slightly larger, for example 12 to 15 cm.

In the following an advantageous embodiment of the invention will be explained in more detail by way of figures.

In FIG. 1 a sectional view of a locking device is shown which comprises a cap plate 1 and a bushing 2 which is movably connected to the cap plate 1. The bushing 2 is provided with an internal thread 3 into which the external thread of an anchor rod end shown in FIG. 2 is inserted. This anchor rod end is provided with a tip 5, in order to be able to easily thread the end into the internal thread 3 of the locking device. At one end the bushing 2 is provided with an outer circumferential groove 6 which is provided by flanges 7 and 8 which radially protrude from the bushing 2. The flanges 7 and 8 show an arcuate section such that the bushing 2 may be displaced like a joy stick in relation to the cap plate 1. A rim area 9 of the opening of the cap plate 1 protrudes into this groove 6, having an allowance such that the bushing 2 remains free in relation to the cap plate 1. Especially for this reason the rim area 9 is spaced apart from the outer circumference of the bushing 2.

A screw 10 passes through the cap plate 1 and is introduced through the bushing 11 which is mounted opposite to the bottom side of the cap plate 1, the end of the screw 10 which is provided with the thread may be screwed into a wall formwork in order to be able to mount the cap plate 1 to this wall formwork. The bottom side of the cap plate 1 comprises a bolt 12 protruding from the bottom side which protrudes into an opening of the designated wall formwork in order to be able to mount the cap plate to the back side of a wall formwork in a torque-proof manner. The bottom side of the cap plate then is adjacent to the back side of a wall formwork such that the thread 3 is aligned with an opening which passes through the wall formwork. The screw 10 is rotatably supported by the bushing 11, but is preferably secured against falling out of the bushing 11 such as for example by a circumferential groove 13, into which for example a spring protrudes which is connected to the bushing 11.

The screw 10 is provided with an oval handle 14, in order to be able to manually mount the screw 10 to a wall formwork. The oval handle 14 extends transversally to the longitudinal extension of the screw 10.

The bushing 2 having the internal thread 3 is passed by a cylindrical stop 15 at the end adjacent to the cap plate 1. The stop 15 extends transversally to the longitudinal extension of the bushing 2, i.e. passing a transversal bore hole of the bushing 2 which functions as a support for the stop 15. The stop 15 may be twisted but may not be pulled out of the bushing 2. This will be prevented by the radially protruding spring 16 at one end and will be prevented at the other end by a locking ring 17. The stop 15 comprises a transversal bore hole 18 which is dimensioned and may be aligned by way of rotating the stop 6 such that an end which is screwed into the thread 3 of the bushing 2 of an anchor rod may pass through the hole 18. The hole 18 then is aligned with the thread 3. In this aligned position the stop 15 has been removed from its stop position.

In FIG. 1 there is show a stop position of the stop 15. If one end of an anchor rod is screwed into the thread 3 of the bushing 2 the tip 5 of the anchor rod end finally will contact the stop 6, such that the anchor rod may not be screwed any further into the thread 3. In order to allow further insertion the stop 15 shown in FIG. 1 first must be twisted by 90°.

In order to be able to smoothly twist the stop 15 it has a handle 19. The handle 19 is similar to the handle 14. However, in comparison to handle 14 the handle 19 is shown twisted by 90°. Shown in top view the oval handle 19 thus has a longitudinal extension which corresponds to the extension of the transversal bore hole 18 thus signalizing the extension of this transversal bore hole 18.

From the bushing 2 a yoke which is attached thereto protrudes towards guiding bushing 11 and encloses the latter with its two ends on two sides thus being able to prevent undesired twisting of the thread 3. The yoke 27 together with the guiding bushing 11 thus forms the torsion protection for the thread 3.

The anchor rod shown in FIG. 2 has a central area 20 having a smooth surface, the central area tapering towards the tip 5. The other end of the anchor rod in turn is provided with a thread 21.

In FIG. 3 a sectional view of two adjacent wall formworks 22 and 23 is exemplified, which are erected for the manufacture of a concrete wall. At the back side of the wall formwork 23 a locking device as shown in FIG. 1 is mounted by way of screw 10 and bolt 12 in a torque-proof manner. The anchor rod has been passed through the openings 24 and 25 of the two wall formworks 22 and 23 starting from the back side of the wall formwork 22 and subsequently has been screwed into the thread 3 of the bushing 2 until the tip 5 of the anchor rod is in contact with the stop 15, as it is depicted. The thread 4 of the anchor rod now is located exterior of the area between the two wall formworks 22 and 23 which is filled with concrete. Also the other end having the thread 21 is located exterior of the area to be cast with concrete. Between the two front sides of the two wall formworks 22 and 23 there is a distance 26.

Another locking device which is not shown finally is screwed onto the thread 21 of the anchor rod until it is adjacent to the back side of the wall formwork 22 in order to absorb forces. Advantageously this other locking device is also connected to the back side of the wall formwork 22, for example by way of a screw in order to absorb both tensile and compression forces.

The maximal width of a wall to be produced will not be accomplished unless the two ends of the central area 20 will be adjacent to the front sides of both wall formworks 22 and 23, such that both threads 3 and 21 of the anchor rod do not protrude into the area between the two wall formworks. The minimal width of a wall to be produced will not be accomplished unless the two locking devices have been screwed onto both thread ends 4 and 2, the stop 15 then being removed from its stop position. The locking device furthermore is designed such that a user may tightly connect the end having tip 5 of the anchor rod to the locking device provided with the stop 15 at two defined positions without the need of looking at the locking device at the time of connecting.

The invention claimed is:

1. An anchoring system for a concrete wall formwork, the anchoring system comprising:

an anchor rod;

a first locking device comprising:

a cap plate with an anchor-rod bore hole formed through the cap plate;

a bushing movably mounted to the cap plate and comprising a bore with an axis that passes through the anchor-rod bore hole;

a stop mounted on the bushing and comprising a bore passing through the stop;

wherein a user may connect an end of the anchor rod to the first locking device in a first position or a second position without looking at the first locking device during connection of the anchor rod to the first locking device;

wherein, when the anchor rod is in the first position, the stop is in a first orientation where the bore of the stop is not parallel to the axis of the bore of the bushing so that a tip of the anchor rod is inhibited from passing through the stop; and wherein, when the anchor rod is in the second position, the stop is in a second orientation where the bore of the stop is parallel to the axis of the bore of the bushing so that the tip of the anchor rod can extend past the first position;

a second locking device; and wherein a first end of the anchor rod may be secured to the first locking device and a second end of the anchor rod may be secured to the second locking device.

2. The anchoring system according to claim 1, wherein the anchor rod comprises a non-threaded central area that tapers across a length of the non-thread central area.

3. The anchoring system according to claim 1, wherein the anchoring system is dimensioned for forming concrete walls of between 15 cm and 40 cm in thickness.

4. A locking device for an anchor rod of a wall formwork comprising:

a cap plate with an anchor-rod bore hole formed through the cap plate;

a bushing movably mounted to the cap plate and comprising a bore with an axis that passes through the anchor-rod bore hole;

a stop mounted on the bushing and comprising a bore passing through the stop;

wherein a user may connect an end of the anchor rod to the locking device in a first position or a second position without looking at the locking device during connection of the anchor rod to the locking device;

wherein, when the anchor rod is in the first position, the stop is in a first orientation where the bore of the stop is not parallel to the axis of the bore of the bushing so that a tip of the anchor rod is inhibited from passing through the stop; and wherein, when the anchor rod is in the second position, the stop is in a second orientation where the bore of the stop is parallel to the axis of the bore of the bushing so that the tip of the anchor rod can extend past the first position.

5. The locking device according to claim 4, wherein removal of the stop from the bushing is prevented by a locking ring as well as a spring radially protruding from the stop.

6. The locking device according to claim 4, wherein the stop comprises an elongated handle that extends parallel to the bore of the stop.

7. The locking device according to claim 4, further comprising a mounting device for mounting the locking device to a wall formwork.

8. The locking device according to claim 4, wherein the bore of the bushing comprises a thread adapted for receiving the end of the anchor rod.

9. The locking device according to claim 8, wherein the bushing comprises a flange that extends radially from the bushing to overlap a portion of the cap plate to allow the bushing to articulate relative to the cap plate while at the same time securing the bushing to the cap plate.

10. The locking device according to claim 7, further comprising:

a bolt extending from a bottom side of the cap plate and adapted to be located in a first hole formed into a formwork; and wherein the mounting device comprises a screw adapted to engage a second hole formed into the formwork; and wherein the bolt and the screw secure the locking device from rotation when the anchor rod is threaded into the bore of the bushing.

11. The locking device of claim 4, wherein the second orientation of the stop allows for maximal insertion of the anchor rod into the locking device.

12. The locking device of claim 4, wherein, in the first orientation, the bore of the stop is perpendicular to the axis of the bore of the bushing.

13. The locking device of claim 4, wherein the stop is mounted rotatably on the bushing to permit the bore passing through the stop to be rotated into and out of alignment with the bore of the bushing.

14. A method for mounting an anchoring system according to claim 1 to a wall formwork, the method comprising:

passing the anchor rod through an anchor-rod bore hole of the second locking device;

passing the anchor rod through an opening of a first wall formwork and through an opening of a second wall formwork, wherein the first and second wall formworks comprise front sides that face one another and are 15 cm to 40 cm apart;

directing the anchor rod into the anchor-rod bore hole of the first locking device;

wherein, when the stop is in the first position, the anchor rod is directed into the anchor-rod bore hole of the first locking device until the tip of the anchor rod contacts the stop; and wherein, when the stop is in the second position, the anchor rod is directed into the anchor-rod bore hole of the first locking device so that the tip of the anchor rod passes into the bore of the stop.

* * * * *